US005257809A

United States Patent [19]

Carrizosa

[11] Patent Number: 5,257,809

[45] Date of Patent: Nov. 2, 1993

[54] DETACHABLE ROTARY BROADHEAD APPARATUS HAVING DRILL BIT-LIKE CHARACTERISTICS

[76] Inventor: Robert S. Carrizosa, 5241 W. Peridot, Tucson, Ariz. 85741

[21] Appl. No.: 49,114

[22] Filed: Apr. 19, 1993

Related U.S. Application Data

[63] Continuation-in-part of Ser. No. 890,840, Nov. 2, 1992.

[51] Int. Cl.[5] ..... F42B 6/08

[52] U.S. Cl. ..... 273/422

[58] Field of Search ..... 273/416, 419–423

[56] References Cited

U.S. PATENT DOCUMENTS

| | | | |
|---|---|---|---|
| 1,648,376 | 11/1927 | Blodgett | 273/423 X |
| 2,212,345 | 8/1940 | Krieger | 237/106.5 |
| 3,897,062 | 7/1975 | Christensen | 273/421 |
| 4,175,749 | 11/1979 | Simo | 273/106.5 |
| 4,392,654 | 7/1983 | Carella | 273/423 |
| 4,534,568 | 8/1985 | Tone | 273/421 |
| 4,565,377 | 1/1986 | Troncoso et al. | 273/422 |
| 4,729,320 | 3/1988 | Whitten, III | 273/422 |

*Primary Examiner*—Paul E. Shapiro
*Attorney, Agent, or Firm*—Victor Flores

[57] ABSTRACT

A broadhead arrow having mechanical structure that improves the rotational freedom of the broadhead portion to prolong rotation during penetration of a target. The mechanical structure further includes an arrow tip, formed as a fluted arrow tip structure, that initiates target penetration by producing drill bit-like action upon rotationally contacting a target. The fluted arrow tip is followed by the bladed, rotatably free, broadhead portion having a plurality of elongated blades that are formed having a sharp, edged, concave upper body structure, contoured for cutting and discarding, in a plow-like manner, any target material, such as flesh and bone material encountered during rotary penetration of a target.

15 Claims, 3 Drawing Sheets

DETACHABLE ROTARY BROADHEAD APPARATUS HAVING DRILL BIT-LIKE CHARACTERISTICS

RELATED APPLICATIONS

This application is a continuation-in-part of U.S. patent application Ser. No. 07/890,840, filed on Nov. 2, 1992.

FIELD OF THE INVENTION

The present invention relates generally to archery devices. More particularly, the present invention relates to replaceable arrowheads. Even more particularly, the present invention relates to replaceable arrowheads and broadheads designed for rotation and target penetration.

BACKGROUND OF THE INVENTION

The prior art teaches that archery arrows of aluminum construction are expensive, and as such, has resulted in making the replaceability of the arrowheads an attractive feature in arrow design. Typically, arrowheads are designed for removal from the arrow shafts by means of providing the arrowheads with a threaded shaft which is threadedly secured within an insert provided at the leading end of the arrow shaft, see generally U.S. Pat. No. 2,212,345, teaching an arrowhead threadedly secured to a shaft and also teaching an arrowhead having blades (broadhead) arranged in a spiral manner about the arrow's shank to induce arrow spin. The broadhead arrowhead has evolved to arrowhead designs which include a nose arrow tip portion followed by a broadhead bladed portion, see generally U.S. Pat. No. 4,565,377 teaching also to provide an arrow tip with a partial recessed area to improve penetration of the target. The broadhead arrow, when provided with a separate arrow tip member, has further been designed with structure which allows rotation of the broadhead portion separate from the arrow tip and fletched arrow shaft, see generally U.S. Pat. Nos. 4,175,749 and 4,534,568. The foregoing prior art has also taught to coordinate the pitch of the broadhead blades with the pitch of the fletching to effect improved in-flight characteristics.

However, the foregoing prior art has not taught to provide a combined arrow tip and broadhead portion structure in a broadhead arrow that will prolong rotation of the arrow during penetration of the target, that is, structure that will encourage continuing rotation during penetration into the target.

Thus, a need is seen to exist to further improve the rotational freedom of the broadhead portion, to not only effect improvement of in-flight characteristics, but to also improve and prolong rotation of the broadhead arrow structure during penetration of the target.

Further, a need is further seen to exist to provide an improved arrow tip structure along with improved broadhead blade structure that will jointly effect the above desired prolong rotation and improved penetration into the target, especially hard bone material encountered in hunting large animals.

SUMMARY OF THE INVENTION

Accordingly, the primary object of the present invention is to provide, in a broadhead arrow design, mechanical structure that improves the rotational freedom of the broadhead portion to prolong rotation of the broadhead arrow during flight and penetration of the target.

Another object of the present invention is to provide an improved arrow tip structure along with an improved broadhead blade structure that will jointly effect the above desired prolong rotation during flight and penetration into a target.

The foregoing objects are accomplished by providing a broadhead arrow design comprising, in combination, an improved arrow tip member, an interface base member, and a convave, bladed broadhead member. The arrow tip member comprises a cone-shaped arrowhead structure having a plurality of fluted, drill bit-like, cutting edges, resembling those provided on a dental bur tool. By example, the interface base member comprises a short cylindrical body having a knurled gripping surface for manual tightening, a shafted mounting structure that engages at one end to a mating mounting insert provided at the leading edge of an arrow shaft portion containing the fletching, and a bored end having a concentric flat smooth planar bearing surface, the bored end engages with a shaft portion of the arrow tip member. The smooth planar bearing surface provides a slip-type engagement with a slip washer member interdisposed therebetween the interface member and the bladed broadhead member, in an assembled state. The bladed broadhead member comprises a cylindrical portion, including inner and outer core portions, on which are provided a plurality of elongated blades that are formed having a flat lower body mounting structure, a concave upper body structure, a sharp edge, contoured for cutting and discarding, in a plow-like manner, any target material, such as flesh and bone material encountered during rotary penetration of a target. The elongated blade's flat lower body structure is further formed for being spirally embedded along the outer core portion. The inner core portion is formed from a hollow, hardened metallic material, such as steel, and the outer core portion is preferably formed from a durable plastic material suitably bonded to the inner core portion and the flat lower body mounting structure of the elongated blades. The metallic inner cylindrical core portion is formed for maximum allowable rotation, and in addition to the elongated smooth hollowed interior core portion through which the arrow tip shaft fits, the inner core portion further comprises opposing first and second flanged ends that help contain the outer plastic core portion therebetween, and that also provide a smooth bearing surface for slip contact with the above mentioned slip washer at one end, and for a similar slip contact with a recessed rear portion of the fluted arrow tip member. The plurality of broadhead blades are also spirally embedded along the body of the outer cylindrical core portion to induce arrow spin, especially when the blade's pitch is coordinated with the pitch of the fletching. In an assembled state, the base member attaches to the leading end of the arrow shaft containing the fletching, the arrow tip shaft mounts to the base member's bore end, the slip washer and broadhead are installed concentric to the arrow tip shaft in a rotatably secured manner prior to the tip shaft being mounted to the bore end of the interface member. Also, the lagging rear portion of each cutting lip of the fluted arrow tip is formed with an inward taper to effect a blended junction with the leading flanged end of the broadhead inner core portion. The blended junction provides a smooth transition point for any cut target material, cut by the fluted arrow tip, to enter the contoured broadhead blade's domain for further discarding action and to facilitate further cutting action by the broadhead's blade. Thus, the structure of the broadhead arrow of the present invention, not only facilitates enhanced stable spin of the arrow during flight, but also further facilitates prolong rotation of the arrow tip and broadhead during penetration by virtue of the provided fluted arrow tip and contoured spirally embedded arranged broadhead blades.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 1:
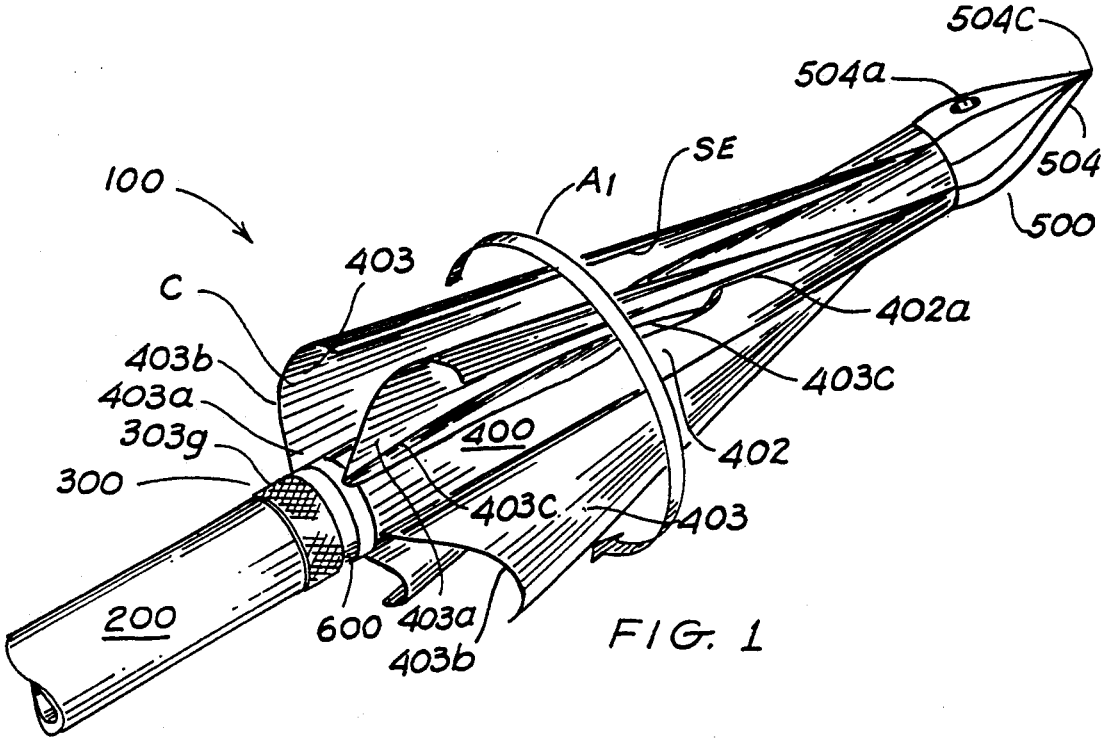
FIG. 1 is a perspective view of the leading end portion of a broadhead arrow illustrating the structural improvements of the concave bladed broadhead and the fluted arrow tip, in accordance with the present invention.
Figure 2:
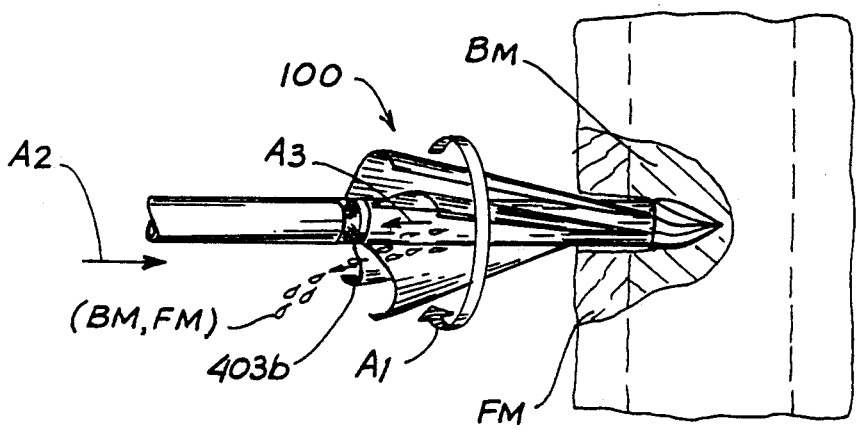
FIG. 2 is a simulated illustration of the broadhead arrow in accordance with the present invention showing drill-bit like penetration into a target.

Referring now to FIG. 1 where the present invention is embodied in a leading end portion 100 of a broadhead arrow. The improved structure 100 comprises a shafted arrow tip member 500, an arrow shaft interface base member 300, and a concave bladed broadhead member 400. A variation of the invention may comprise structure where the interface member is eliminated (not shown). As illustrated in FIG. 1, arrow tip member 500 includes a plurality of spirally fluted sharp edge cutting members 504, including the tip end **504*c* and through-hole tightening means 504*a*. Interface base member 300, and its knurled gripping outer surface 303*g*, is shown attached to fletching-containing arrow portion 200, and being disposed adjacent slip washer 600. Broadhead 400 is shown to indicate that it is a freely rotating body capable of rotary motion A1, shown by example in a clockwise direction. The plurality of elongated blades 403 are preferably formed having a flat lower body surface structure 403*a* and also having spiral bottom edge structure 403*c* for being spirally disposed along inner core surface 401*c* and embedded in outer portion 402 up to junction 402*a*. FIG. 1 further shows elongated broadhead blades 403 formed having a concave upper body surface C and sharp edge SE, contoured for cutting target material while the broadhead apparatus is rotating and penetrating the target. FIG. 2 exemplifies the desired penetration effect to carve and discard, in a plow-like manner, any and all cut target material, such as flesh and bone material BM, FM, entering blade's 403 domain during target penetration, as indicated by arrows A2, A3 with target material exiting at blade end 403*b***.

Figure 3:
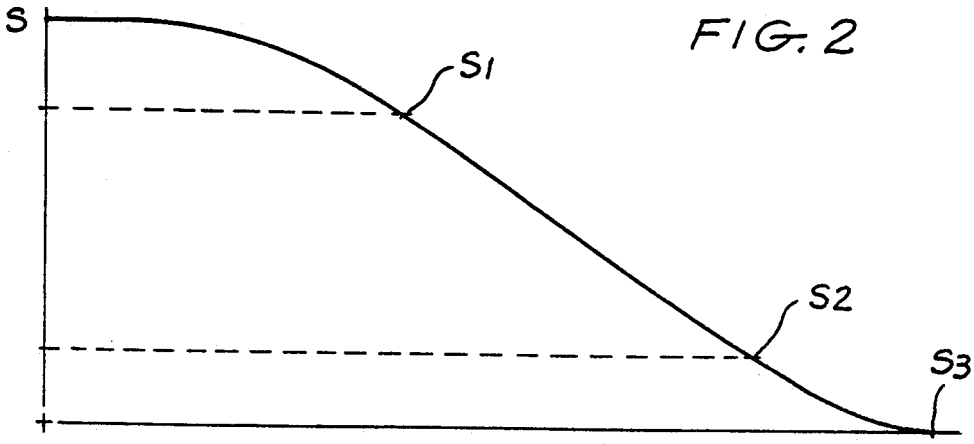
FIG. 3 is a graphical representation of broadhead slippage as measured from a static state prior to flight to a completed target penetration state.

FIG. 3 is a graphical representation of relative broadhead slippage as encountered at a static state S, an in-flight state S1, a target contact state S2 and at final target penetration state S3. The decreasing slippage is due to the different amount of contacting force experienced at the bearing interfaces between bearing surface **303*f* of base member 300 and slip washer surface 602, and slip washer surface 601 and flanged bearing surface 401*e* on inner core cylindrical portion 401 of the broadhead member 400, encountered during the different events, see generally FIG. 5. Further, the material composition of both the base member 300 and the inner core portion 401 is selected to be of harder composition than the composition of slip washer 600 to encourage maximum slippage. By example, slip washer 600 may be formed from brass, the inner core portion 401 may be formed from steel and the base member 300** may be formed from aluminum.

Figure 4:
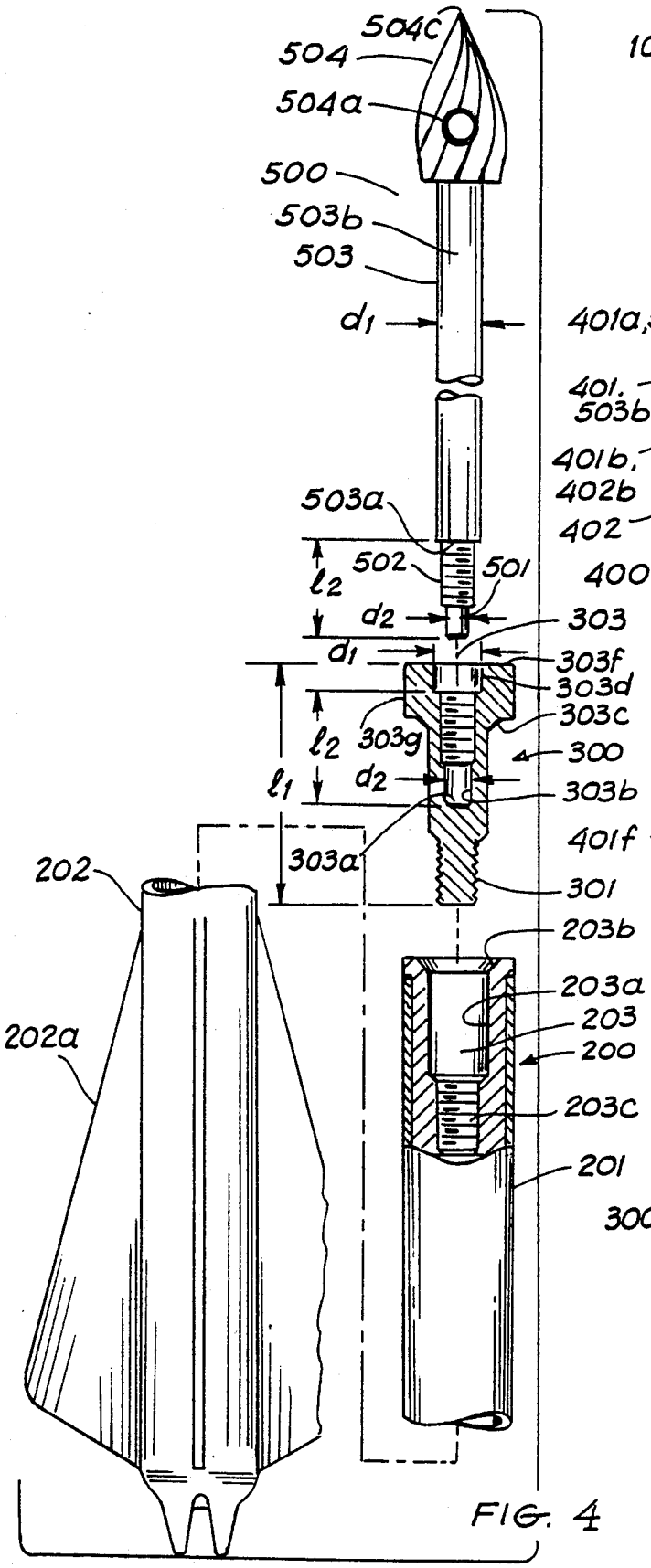
FIG. 4 is an exploded assembly view of an arrow without the broadhead illustrating the interface base member attachment structure and the fluted and shafted arrow tip structure.
Figure 5:
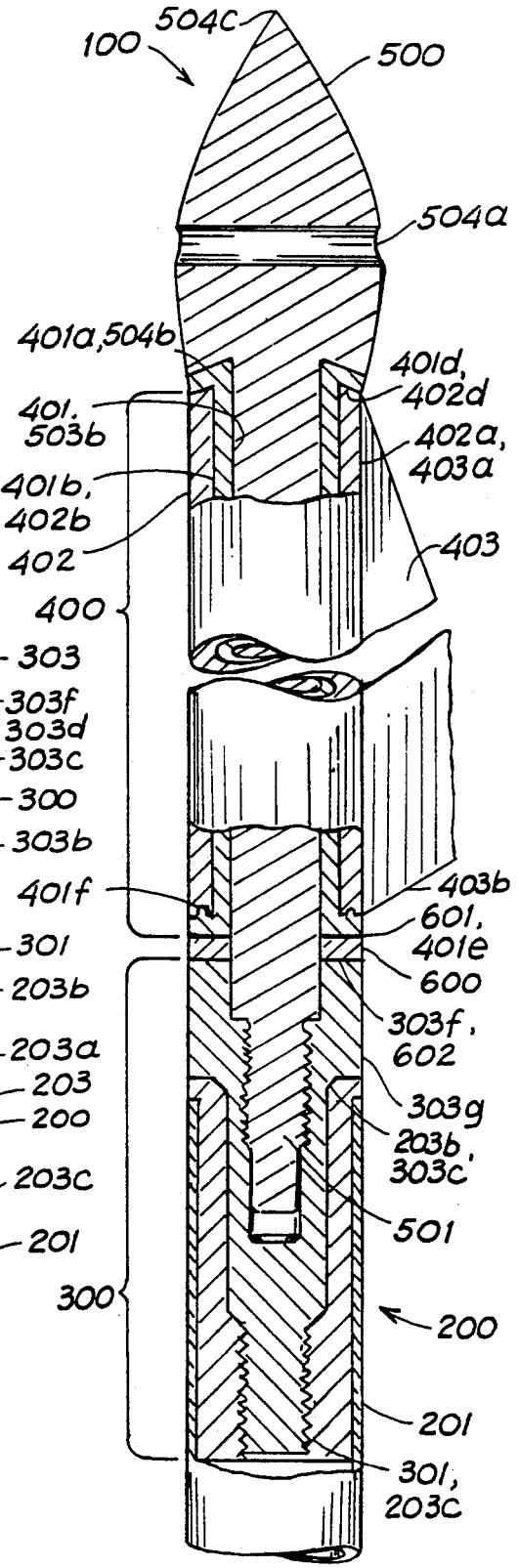
FIG. 5 is an enlarged cross sectional view of an assembled leading end portion of the broadhead in accordance with the present invention, illustrating the seated interface base member, the seated arrow tip shaft and the rotatably secured broadhead member.

FIG. 4 is an exploded essembly view of an arrow without broadhead 400. As illustrated, arrow tip member 500 includes a plurality of spiral fluted cutting members 504, including the tip end **504*c*, through-hole tightening means 504*a* and an integral shaft 503 having an elongated smooth portion 503*b* and a threaded portion 502 with a distal end 501. Arrow tip member 500 being formed from steel to sustain rugged target contact. FIG. 5 further illustrates, in cross section, the internal structure of interface base member 300, the insert structure 203 of arrow portion 200 and the threaded shaft 503 of arrow tip 500. Base member 300 is shown having a length 11 that conforms to the depth of insert structure 203 up to junction 203*b*, 303*c*. Base 300 includes a threaded attachment structure 301 that extends upward toward shoulder portion 303*c*, and an outer knurled grip portion 303*g* having a bearing surface 303*f*. As best seen in FIG. 5, threaded structure 301 conforms to insert threaded structure 203*c* and the shafted shoulder portion 303*c* conforms to beveled entry 203*b* and bore 203*a* on leading end 201 of arrow portion 200. Base member 300 is further provided with bore 303 having an interior portion of depth 12 that is equivalent to the length 12 of the threaded portion 502 of arrow tip shaft 503. Bore 303 provides a firm, deep seat engagement of the threaded end 502 of the arrow tip shaft 503. Additionally, bore 303 is provided with an extended non-threaded bore portion 303*b*, with bottom end 303*a* that firmly engages the distal end 501 of arrow shaft 503, which distal end 501 is formed having a diameter d2 that is equivalent to bore 303*b*'s diameter. Further, bore 303 is provided with an entry bore portion 303*d* having a diameter d1 that is equivalent to the outer diameter of shaft 503. Bore portion 303*d* is provided with a shoulder region for seating arrow tip shoulder portion 503*a*. Lagging end arrow portion 200 is also illustrated with fletching 202*a* at arrow end 202. It should be understood that although fletching 202***a* is not shown pitched with respect to the arrow's longitudinal axis, the fletching's pitch may be coordinated with the pitch of blades 403 to optimize in-flight stability.

FIG. 5 shows an enlarged cross sectional view of the assembled leading end portion 100 of a broadhead arrow in accordance with the present invention. As discussed above interface base member 300 is illustrated in a seated state within insert 203. Threaded portion 501 of arrow tip shaft 503 is illustrated in a firmly seated state within bore 303 of base member 300. FIG. 5 particularly shows broahead 400 installed over shaft 503 and in contact with smooth surface 503*b* of arrow tip shaft 503. Broadhead 400 comprises a two-piece cylindrical portion including inner core portion 401 and an outer core portions 402 on which flat lower body blade surface structure 403*a* is spirally embedded. Inner core portion 401 is formed from a hardened metallic material, such as steel, and outer core portion 402 is preferably formed from a durable plastic material suitable for bonding to inner core portion 401 at junction 401*b*, 402*b* and bonding to and retaining flat blade portion 403*a* from edge 403*c* up to outer surface 402*a*. Inner cylindrical core portion 401 is formed for maximum rotation, and in addition to having an elongated smooth hollow interior core portion through which the arrow tip shaft 503 fits, inner core portion 401 further comprises first flanged end 401*e* and second tapered flanged end 401*a* that help contain outer core portion 402 therebetween. A plurality of retention nipple portions 401*f* are provided on an inner portion of flange 401*e* to aid in securing outer core portion 402 to inner core 401. First flanged end 401*e* is formed having a smooth bearing outer surface for slip contact with slip washer surface 601, while second tapered flanged end 401*a* is also provided with a smooth bearing surface for a slip contact engagement with lagging, tapered end 504*b* of flutes 504. An inner wall portion 401*d* of second flanged end 401*a* also aids in securing outer core portion 402 at leading end 402*d* of inner core 402.

Figure 6:
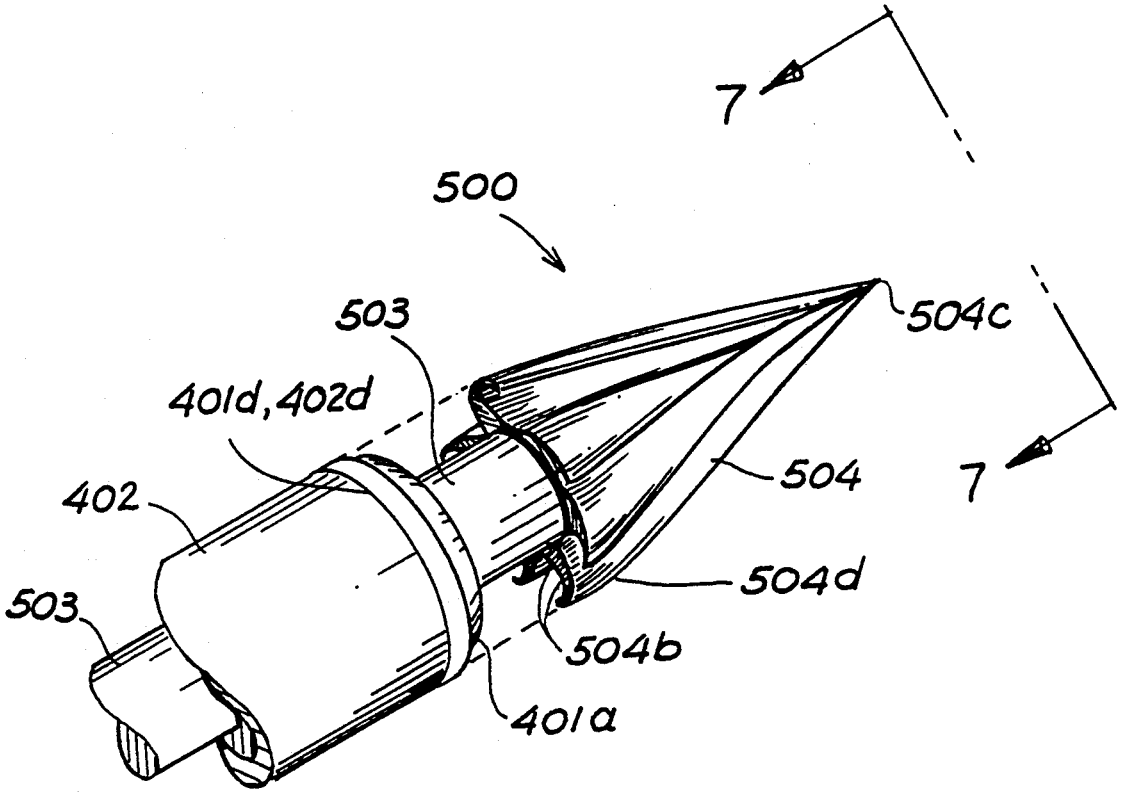
FIG. 6 is a perspective exploded assembly view of the fluted arrow tip and the flanged leading end inner core cylinder portion, illustrating the tapered structure that forms the blended junction between the two pieces.
Figure 7:
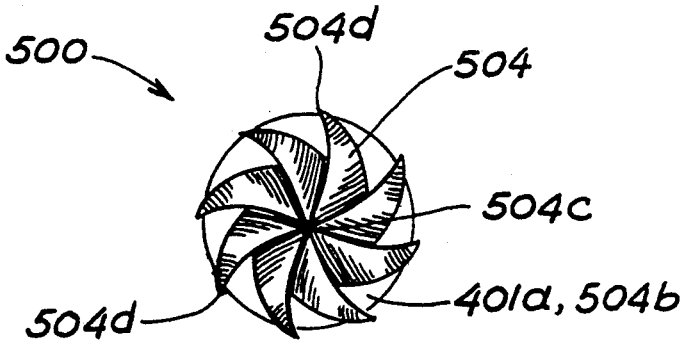
FIG. 7 is an enlarged frontal view of the fluted arrow tip taken along line 7—7 in FIG. 6 illustrating the fluted attributes of the arrow tip.

FIG. 6 shows the fluted arrow tip member 500 and the plurality of fluted cutting members 504 extending from tip 504*c*, to high cutting portion 504*d*, to the lagging rear portion 504*b* for rotational engagement with the inner core flanged portion 401*a*. Each rear fluted end portion 504*b* is formed with an inward taper having a smooth body surface that forms a blended slip junction with leading flanged end 401*a* of inner core portion 401. The blended slip junction 401*a*, 504*b* provides a smooth transition point for any cut target material, cut by the fluted cutting members 504, to enter the domain of the broadhead's concave upper body portion C for further discarding action and to facilitate further cutting action by the broadhead's blade. FIG. 7 is an enlarged frontal view of the arrow tip 500 taken along line 7—7 in FIG. 6 illustrating the arrow tip 504*c*, the plurality of fluted cutting members 504 with high cutting portion 504*d* and the slip junction 401*a*, 504*b*.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. A broadhead arrow apparatus, said apparatus comprising:

an arrow tip member having an end with a point, a base and a plurality of fluted, drill bit-like, cutting members extending from said point to said base and spiraling about said tip in a first direction; and a bladed broadhead member rotatably secured to said arrow tip portion, said bladed broadhead member comprising an elongate core member having a leading end adjacent said tip member, a trailing end and a plurality of blades, each blade having a flat lower body portion mounted to said core in a spiral about said core in the same direction as the cutting members of said tip, and an upper body portion extending away from said core and curved about said core in a direction opposite to the direction of spiral.

2. A broadhead arrow apparatus, as described in claim 1, further comprising:

a slip washer disposed behind the trailing end of the core.

3. A broadhead arrow apparatus, as described in claim 2, wherein said core portion is cylindrical and has a hollow inner core portion and an outer core portion, said inner core portion being formed from a hard metal material, and said outer core portion being formed from a durable plastic material, each blade being disposed along and embedded in said outer core portion.

4. A broadhead arrow apparatus, as described in claim 3, wherein:

said inner core portion further comprises opposing lagging and leading flanged bearing surface ends, said slip washer being formed of a softer material than said inner core portion; and said slip washer being disposed behind said lagging flanged bearing surface end.

5. A broadhead arrow apparatus, as described in claim 1, further comprising:

a shaft portion on said arrow tip member; and an interface base member having a leading end attached to said tip member and a lagging end adapted to be attached to an insert mounting provided on a leading end of a fletching-containing arrow shaft portion, said bladed broadhead member being rotationally mounted on said shaft portion.

6. A broadhead arrow apparatus, as described in claim 5, further comprising:

a slip washer disposed between said interface base member and said broadhead member; and wherein the base of said tip member comprises a tapered undercut; said bladed broadhead member being disposed in rotational securement on said shaft portion and between said tapered undercut and said slip washer.

7. A broadhead arrow apparatus, as described in claim 5, wherein:

said leading end of said interface base member comprises an interior threaded bore portion, a narrower, non-threaded bore portion extending rearwardly from said interior threaded bore portion, a wider, non-threaded bore portion extending forwardly from said interior threaded bore portion, said interior threaded bore portion, said narrower, non-threaded bore portion and said wider, non-threaded bore portion providing a firm engagement structure for said shaft portion.

8. A broadhead arrow apparatus, as described in claim 1, wherein:

said core comprises a cylindrical portion formed having a hollow inner core portion and an outer core portion, said inner core portion further comprises opposing lagging and leading flanged bearing surface ends, said leading flanged bearing surface end being forwardly tapered, and said fluted cutting members having an inwardly tapered lagging end for forming a smooth surfaced slip junction with said leading flanged bearing surface end to facilitate rotation of said bladed broadhead member and an unobstructed feed of target material from fluted cutting members to said plurality of elongated blades.

9. A broadhead arrow apparatus, said apparatus comprising:

an arrow tip member having an end with a point, a base, a plurality of fluted, drill bit-like, cutting members extending from said point to said base and spiraling about said tip in a first direction, and an elongated shaft portion extending rearwardly from said base;

an interface base member having a leading end and a lagging end, said shaft portion being attached to said leading end and said lagging end adapted to be attached to an insert mounting provided on a leading end of a flectching-containing arrow shaft portion; and a bladed broadhead member rotatably secured on said shaft portion, said bladed broadhead member comprising an elongate core member having a leading end abutting the base of the tip member and a plurality of elongated blades, each blade having a flat lower body portion mounted to said core in a spiral about said core in the same direction as the cutting members of said tip, and an upper body portion extending away from said core and curved about said core in a direction opposite to the direction of spiral.

10. A broadhead arrow apparatus, as described in claim 9, further comprising:

the base of said tip member having a tapered undercut;

a slip washer disposed between said interface base member and said broadhead member; and wherein said bladed broadhead member being disposed in rotational securement on said shaft portion between said tapered undercut and said slip washer.

11. A broadhead arrow apparatus, as described in claim 10, wherein:

said care portion is cylindrical and has a hollow inner core portion and an outer core portions, said inner core portion further comprises opposing lagging and leading flanged bearing surface ends, said inner core portion being formed from a hard metal material, and said outer core portion being formed from a durable plastic material, each elongated blade being disposed along and embedded in said outer core portion;

said slip washer being formed of a softer material than said inner core portion; and said slip washer being disposed between said lagging flanged bearing surface end and said leading end of said interface base member to effect said rotatable securement of said broadhead member.

12. A broadhead arrow apparatus, said apparatus comprising:

an arrow tip member having an end with a point and a base, a plurality of fluted, drill bit-like, cutting members extending from said point to said base and spiraling about said tip in a first direction, and an elongated shaft portion extending rearwardly from said base;

an interface base member having a leading end and a lagging end, said shaft portion being attached to said leading end and said lagging end adapted to be attached to an insert mounting provided on a leading end of a fletching-containing arrow shaft portion;

a bladed broadhead member rotatably secured on said shaft portion, said bladed broadhead member comprising an elongate core member having a leading end abutting the base of the tip member and a plurality of elongated blades, each blade having a flat lower body portion mounted to said core in a spiral about said core in the same direction as the cutting members of said tip, and an upper body portion extending away from said core and curved about said core in a direction opposite to the direction of spiral; and a slip washer disposed between said interface base member and said broadhead member.

13. A broadhead arrow apparatus, as described in claim 12, wherein:

said care portion is a cylindrical and has a hollow inner core portion and an outer core portions, said inner core portion further comprises opposing lagging and leading flanged bearing surface ends, each elongated blade being disposed along and embedded in said outer core portion; and said slip washer being disposed between said lagging flanged bearing surface end and said leading end of said interface base member to effect said rotatable securement of said broadhead member.

14. A broadhead arrow apparatus, as described in claim 13, wherein:

said leading flanged bearing surface end being forwardly tapered, and said fluted cutting members having an inwardly tapered lagging end defining said base and forming a smooth surfaced slip junction with said leading flanged bearing surface end to facilitate rotation of said bladed broadhead member and an unobstructed feed of target material from fluted cutting members to said plurality of elongated blades.

15. A broadhead arrow apparatus, as described in claim 12, wherein:

said arrow tip member further comprises a transverse through-hole for inserting a tool for tightening said arrow tip member to said interface base member; and said interface base member comprises a knurled outer surface for providing a gripping means for tightening said base member to said insert mounting.

* * * * *